US010219631B1

(12) United States Patent
Jimenez

(10) Patent No.: US 10,219,631 B1
(45) Date of Patent: Mar. 5, 2019

(54) CHAIR WITH BACKREST MOUNTED ITEM HOOK AND DRINK HOLDER

(71) Applicant: Filemon Jimenez, Huntington Beach, CA (US)

(72) Inventor: Filemon Jimenez, Huntington Beach, CA (US)

( * ) Notice: Subject to any disclaimer, the term of this patent is extended or adjusted under 35 U.S.C. 154(b) by 0 days.

(21) Appl. No.: 15/812,094

(22) Filed: Nov. 14, 2017

(51) Int. Cl.
*A47C 7/70* (2006.01)
*A47C 7/64* (2006.01)
*A47C 7/62* (2006.01)

(52) U.S. Cl.
CPC ..... *A47C 7/70* (2013.01); *A47C 7/62* (2013.01); *A47C 7/622* (2018.08); *A47C 7/64* (2013.01)

(58) Field of Classification Search
CPC .. A47C 7/70; A47C 7/62; A47C 7/622; A47C 7/64
USPC ..... 297/188.03, 188.04; 397/188.05
See application file for complete search history.

(56) References Cited

U.S. PATENT DOCUMENTS 226,087 A * 3/1880 Lindsey ..... A47C 7/62 211/119.007
1,216,730 A * 2/1917 Quiggle ..... A47C 7/62 248/215
2,284,811 A * 6/1942 Ferrelle ..... A47C 7/70 108/38
D162,959 S 4/1951 Janes et al.
3,149,879 A * 9/1964 Steiber ..... A47C 7/64 211/1
3,795,422 A * 3/1974 Robinson ..... A47C 7/70 244/122 R
4,302,046 A 11/1981 Lazazzero
4,466,659 A * 8/1984 Carpentier ..... A47C 7/70 108/149
4,957,254 A 9/1990 Hill et al.
5,415,457 A * 5/1995 Kifer ..... B60N 2/70 224/275
D495,589 S 9/2004 Goodman et al.
6,976,735 B1 12/2005 Bergin
7,281,762 B1 10/2007 Getfield
8,210,605 B2 * 7/2012 Hough ..... B60R 11/0252 297/188.05
8,397,963 B2 * 3/2013 Singh ..... B60N 3/004 224/275
8,434,415 B1 * 5/2013 Federici ..... A47C 7/62 108/38
8,870,281 B1 * 10/2014 Boone ..... A47C 7/746 297/180.1
2002/0043826 A1 * 4/2002 Ingram ..... B60N 3/004 297/146

(Continued)

*Primary Examiner* — Gary C Hoge

(57) ABSTRACT

A backrest mounted item hook and drink holder including an arm member which is extendible from a first recess within a rearward side of a backrest portion of a chair body to hang a purse or other item therefrom and a drink holder rack extendible from a second recess within the rearward side. The drink holder rack also has a pivotable upper portion with a convex exterior side and a central aperture and a pivotable lower tray portion which has a bottom end to support a lowermost end of a bottled drink container thereon while an uppermost end of the bottled drink container is retained within the central aperture. When each of the arm member and the drink holder rack is in the retracted condition, the chair body is stackable atop another chair body.

7 Claims, 6 Drawing Sheets

(56) References Cited

U.S. PATENT DOCUMENTS

| | | | | |
|---|---|---|---|---|
| 2008/0208694 | A1* | 8/2008 | Baggott | A47B 5/00 705/14.49 |
| 2011/0248531 | A1 | 10/2011 | Powell | |
| 2014/0312673 | A1* | 10/2014 | Chen | B60N 2/90 297/391 |

* cited by examiner

CHAIR WITH BACKREST MOUNTED ITEM HOOK AND DRINK HOLDER

BACKGROUND OF THE INVENTION

Various types of holders and supports for storing items on various support structures, such as a handle, a pane of a rolldown vehicle window, an arm of a chair, and a back of chair, such as a beauty salon chair or a church pew, are known in the prior art. However, what is needed and what the present device provides is a chair with a backrest mounted item hook and a backrest mounted drink holder extendible from a retracted condition within a first recess and a second recess, respectively, in a rearward side of the chair during use to an extended condition for use. When the item hook and drink holder are in the retracted condition, the chair is stackable atop another chair.

FIELD OF THE INVENTION

The present invention relates to a chair with a backrest mounted item hook and drink holder.

SUMMARY OF THE INVENTION

The general purpose of the present chair with a backrest mounted item hook and drink holder, described subsequently in greater detail, is to provide a chair with a backrest mounted item hook and drink holder which has many novel features that result in a chair with a backrest mounted item hook and drink holder which is not anticipated, rendered obvious, suggested, or even implied by prior art, either alone or in combination thereof.

To accomplish this, the present chair with a backrest mounted item hook and drink holder includes a chair body having a seat portion, a backrest portion attached to a frame disposed proximal a rear side of the seat portion, and a pair of legs attached to the seat portion and to a pair of outer portions of the frame. A first recess is disposed within a rearward side of the backrest portion. A parallelepiped arm member is pivotable from a retracted condition within the first recess to an extended condition, in which the arm member is employable for hanging a purse or other items, such as a coat, a briefcase, or an umbrella, to eliminate the need to search for a location, such as a ground or floor, on which to place the purse or the other items.

A second recess is disposed within the rearward side of the backrest portion in a position proximal the first recess and is provided to house a pivotable drink holder rack, which pivots from a retracted condition within the second recess to an extended condition. The drink holder rack has an upper portion having a convex exterior side, an interior side pivotably disposed on an upper end of the second recess and a central aperture disposed therebetween. The drink holder rack also has a lower tray portion having bottom end, a front end, right and left ends, a continuous vertical lip, and a proximal end, which is pivotably disposed on a lower end of the second recess. Each of the exterior side of the upper portion and the front end of the lower tray portion is disposed within the second recess when the drink holder rack is in the retracted condition. Each of the upper portion and the lower portion is perpendicular to the backrest portion and each of the exterior side of the upper portion and the distal end of the lower tray portion is disposed outside the second recess and the central aperture of the upper portion is aligned with the bottom end of the lower tray portion in a position directly above the bottom end when the drink holder rack is in the extended condition to support a lowermost end of a bottled drink container on the lower tray portion and an uppermost end of the bottled drink container within the central aperture. When each of the arm member and the drink holder rack is in the retracted condition, the chair body is stackable atop another chair body.

A finger-grippable u-shaped notch is centrally disposed in a portion of the vertical lip on the front end of the lower tray portion of the drink holder rack to assist in grasping the lower tray portion to pivot the lower tray portion from the retracted condition within the second recess to the extended condition.

Thus has been broadly outlined the more important features of the present chair with a backrest mounted item hook and drink holder so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
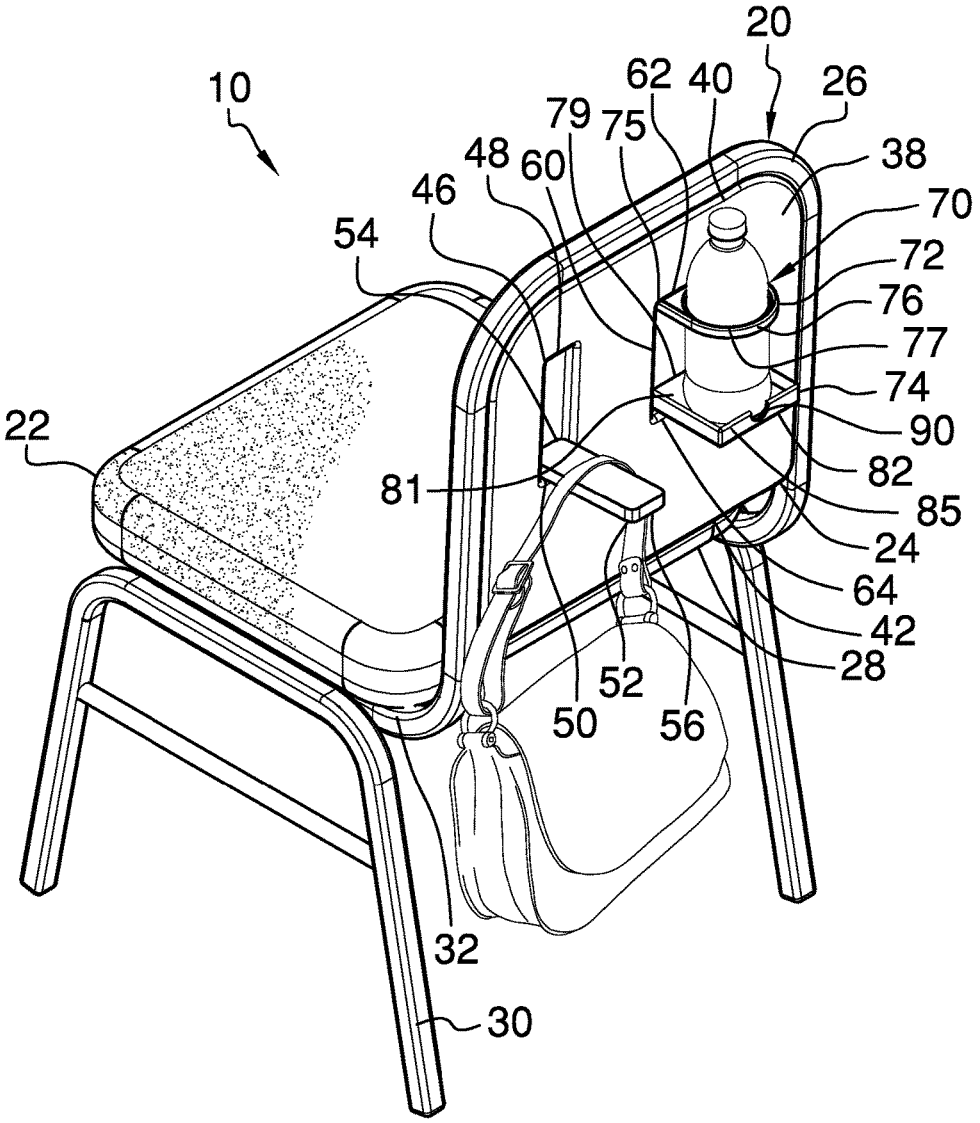
FIG. 1 is an in-use isometric view with an item hook and a drink holder in an open condition.
Figure 2:
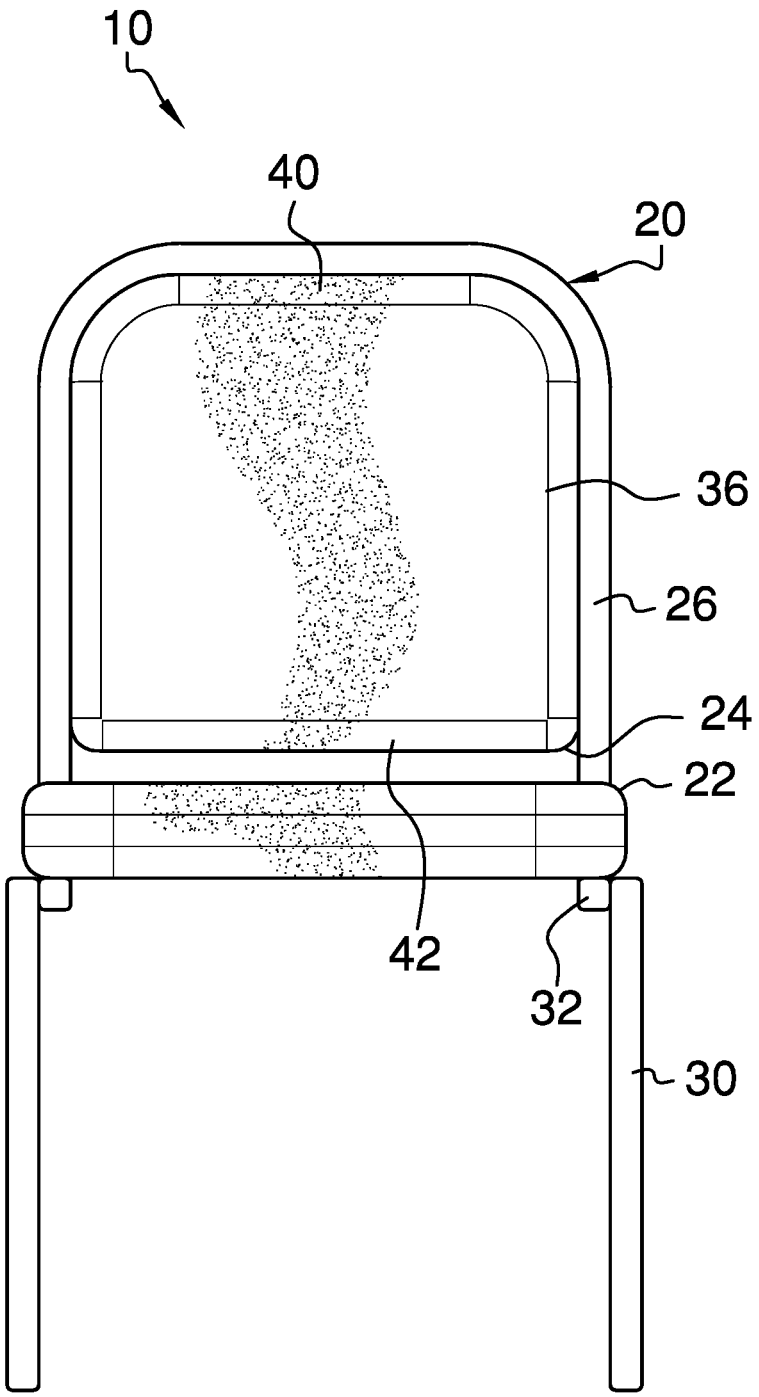
FIG. 2 is a front elevation view.
Figure 3:
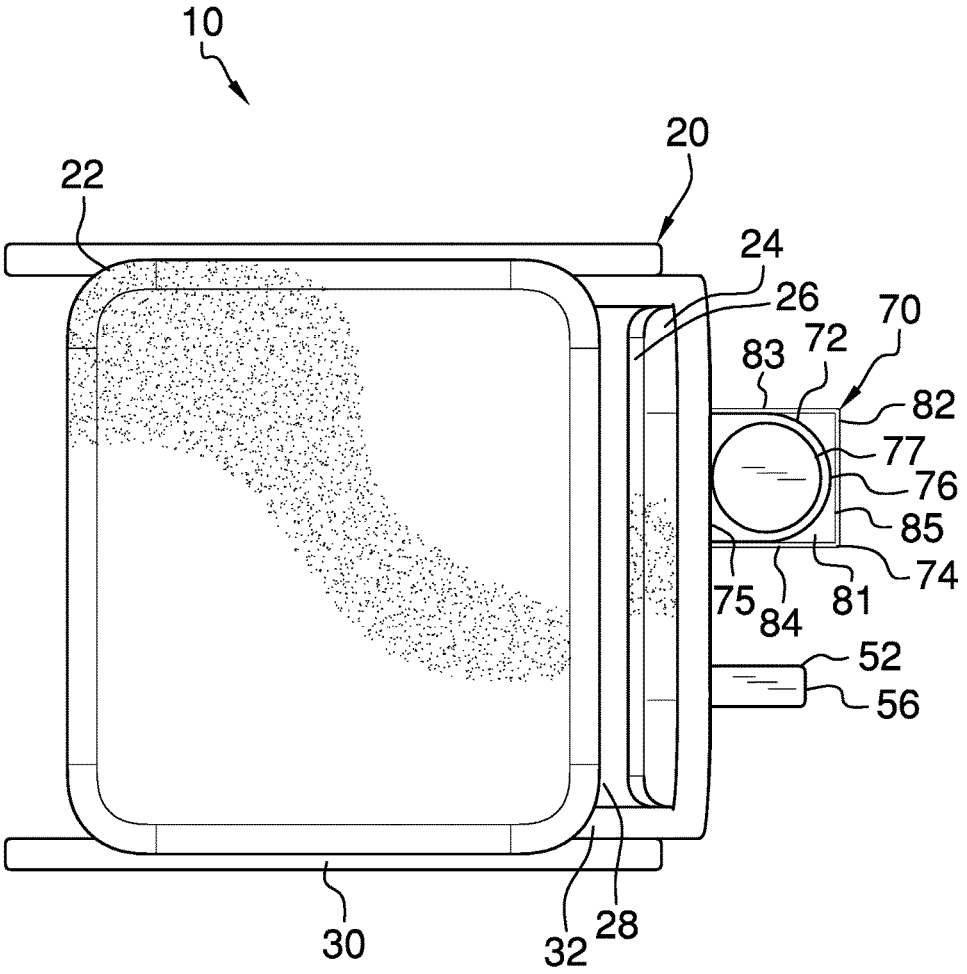
FIG. 3 is a top plan view.
Figure 4:
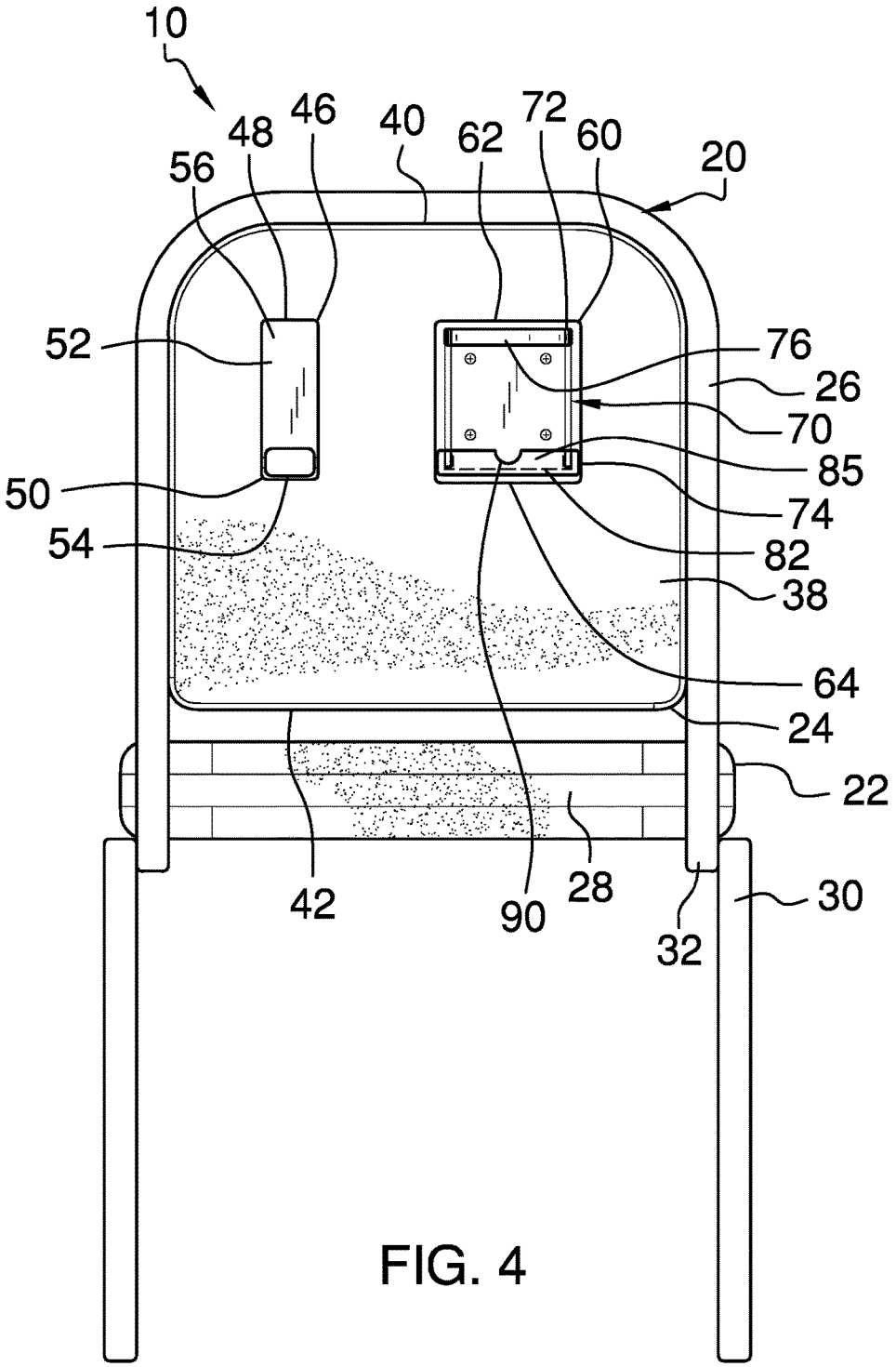
FIG. 4 is a rear elevation view.
Figure 5:
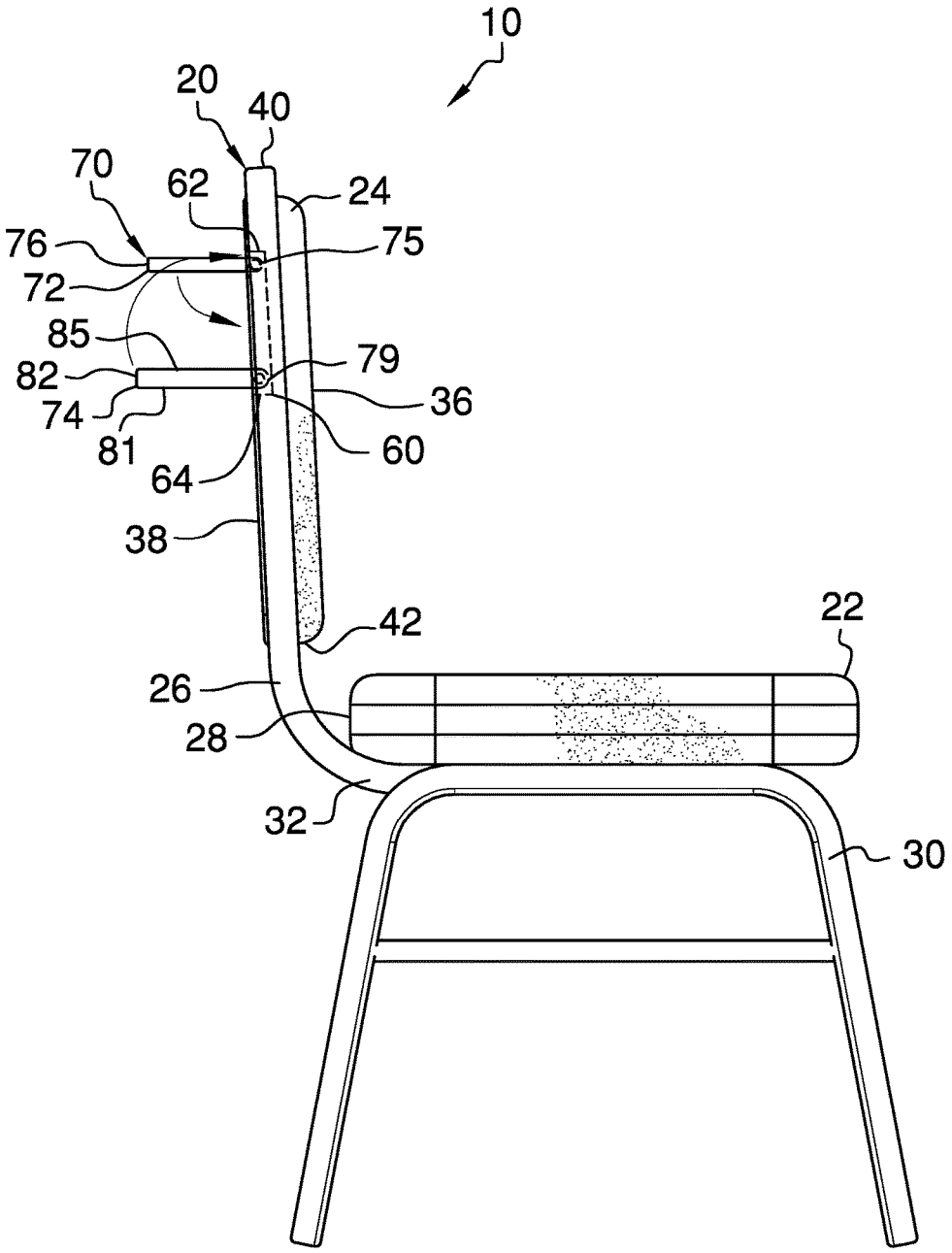
FIG. 5 is a left side elevation view.

With reference now to the drawings, and in particular FIGS. 1 through 6 thereof, an example of the instant chair with a backrest mounted item hook and drink holder employing the principles and concepts of the present chair with a backrest mounted item hook and drink holder and generally designated by the reference number 10 will be described.

Referring to FIGS. 1 through 6 the present chair with a backrest mounted item hook and drink holder 10 is illustrated. The chair with a backrest mounted item hook and drink holder 10 includes a chair body 20 having a seat portion 22, a backrest portion 24 attached to a frame 26 disposed proximal a rear side 28 of the seat portion 22, and a pair of legs 30 attached to the seat portion 22 and to a pair of outer portions 32 of the frame 26. The backrest portion 24 has a forward side 36, a rearward side 38, a top side 40, and a bottom side 42.

A first recess 46 is disposed within the rearward side 38 of the backrest portion 24. The first recess 46 has a top end 48 proximal the top side 40 of the backrest portion 24 and a bottom end 50. A parallelepiped arm member 52 fits within the first recess 46. The arm member 52 has an attachment end 54 and an external end 56. The attachment end 54 is pivotably disposed on the bottom end 50 of the first recess 46. The arm member 52 is pivotable from a retracted condition within the first recess 46 to an extended condition. The external end 56 is disposed within the first recess 46 when the arm member 52 is in the retracted condition. The arm member 52 is perpendicular to the backrest portion 24 and the external end 56 is disposed outside the first recess 46 when the arm member 52 is in the extended condition. The arm member 52 is provided for hanging a purse or other items, such as a coat, a briefcase, or an umbrella, to eliminate the need to search for a location, such as a ground or floor, on which to place the purse or the other items.

Figure 6:
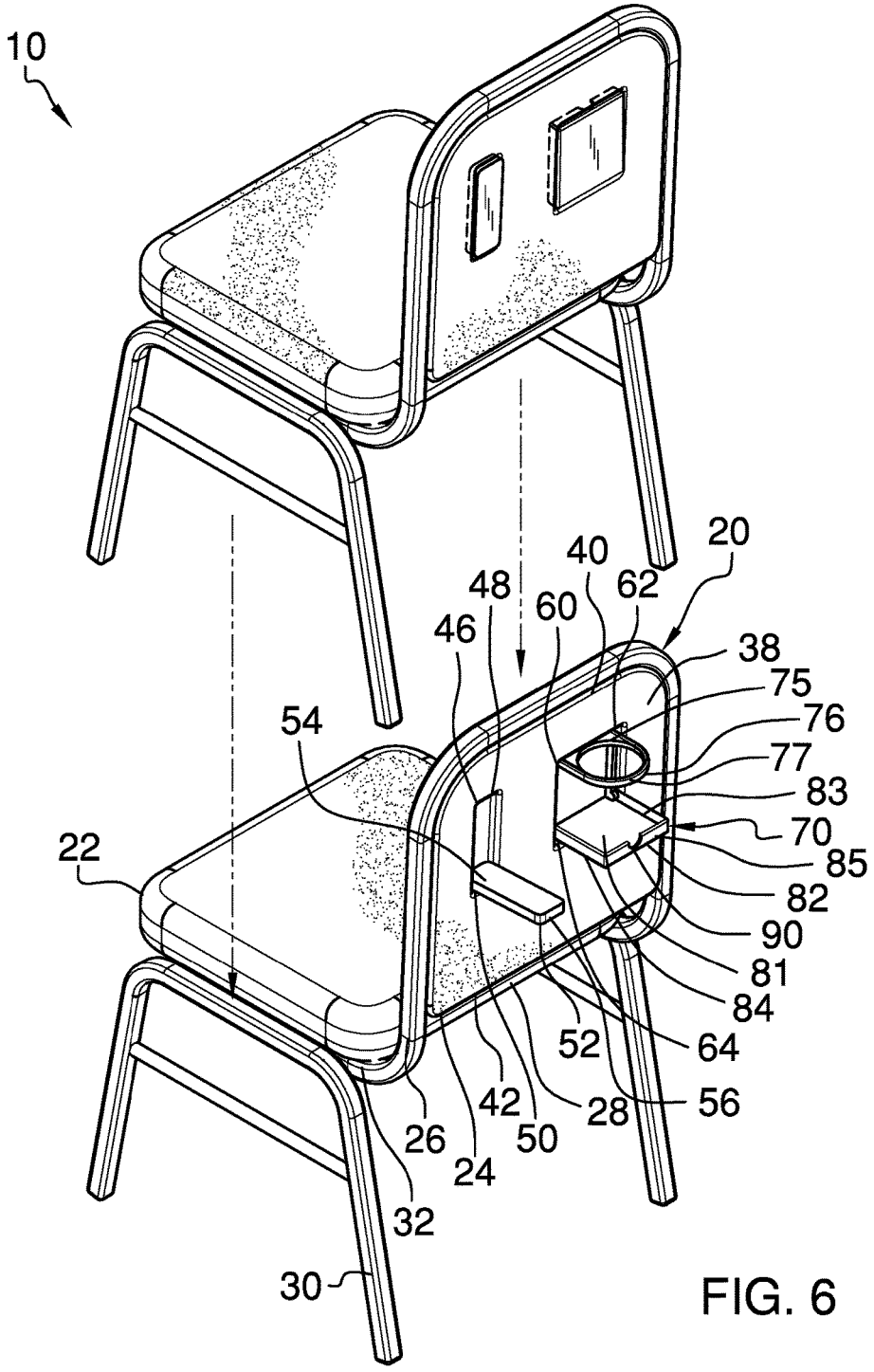
FIG. 6 is an in-use isometric view showing the item hook and the drink holder in the open condition of one chair at the bottom of a stack of chairs and the item hook and the drink holder in the closed condition of another chair at the top of the stack of chairs.

A second recess 60 is disposed within the rearward side 38 of the backrest portion 24 in a position proximal the first recess 46. The second recess 60 has an upper end 62 proximal the top side 40 of the backrest portion 24 and a lower end 64. A drink holder rack 70 fits within the second recess 60. The drink holder rack 70 has an upper portion 72 and a lower tray portion 74. The upper portion 72 has an interior side 75 pivotably disposed on the upper end 62 of the second recess 60, a convex exterior side 76, and a central aperture 77 disposed between the interior side 75 and the exterior side 76. The lower tray portion 74 has a proximal end 79 pivotably disposed on the lower end 64 of the second recess 60, a bottom end 81, a front end 82, a right end 83, a left end 84, and a vertical lip 85 continuously disposed along the front end 82, the right end 83, and the left end 84. The drink holder rack 70 is pivotable from a retracted condition within the second recess 60 to an extended condition. Each of the exterior side 76 of the upper portion 72 and the front end 82 of the lower tray portion 74 is disposed within the second recess 60 when the drink holder rack 70 is in the retracted condition. Each of the upper portion 72 and the lower tray portion 74 is perpendicular to the backrest portion 24 and each of the exterior side 76 of the upper portion 72 and the front end 82 of the lower tray portion 74 is disposed outside the second recess 60 when the drink holder rack 70 is in the extended condition. In addition, the central aperture 77 of the upper portion 72 is aligned with the bottom end 81 of the lower tray portion 74 in a position directly above the bottom end 81 when the drink holder rack 70 is in the extended condition. The drink holder rack 70 is configured to support a lowermost end of a bottled drink container on the lower tray portion 74 and an uppermost end of the bottled drink container within the central aperture 77 when the drink holder rack 70 is in the extended condition, as shown in FIG. 1. When each of the arm member 52 and the drink holder rack 70 is in the retracted condition, the chair body 20 is stackable atop another chair body 20, as shown in FIG. 6.

A finger-grippable u-shaped notch 90 is centrally disposed in a portion of the vertical lip 85 on the front end 82 of the lower tray portion 74 of the drink holder rack 70. The notch 90 is closed proximal the bottom end 81 of the lower tray portion 74. The notch 90 assists in grasping the lower tray portion 74 to pivot the lower tray portion 74 from the retracted condition within the second recess 60 to the extended condition.

What is claimed is:

1. A chair with a backrest mounted item hook and drink holder comprising:

a chair body having a seat portion, a backrest portion, and a pair of legs, the backrest portion having a forward side, a rearward side, a top side, and a bottom side;

a first recess disposed within the rearward side of the backrest portion, the first recess having a top end proximal the top side of the backrest portion and a bottom end;

an arm member, the arm member having an attachment end and an external end, the attachment end pivotably disposed on the bottom end of the first recess, the arm member being pivotable from a retracted condition within the first recess to an extended condition, wherein the external end is disposed within the first recess when the arm member is in the retracted condition, wherein the arm member is perpendicular to the backrest portion and the external end is disposed outside the first recess when the arm member is in the extended condition;

a second recess disposed within the rearward side of the backrest portion in a position proximal the first recess, the second recess having an upper end proximal the top side of the backrest portion and a lower end; and a drink holder rack, the drink holder rack having an upper portion and a lower tray portion, the upper portion having an interior side pivotably disposed on the upper end of the second recess, an exterior side, and a central aperture disposed between the interior side and the exterior side, the lower tray portion having a proximal end pivotably disposed on the lower end of the second recess, a bottom end, a front end, a right end, a left end, and a vertical lip continuously disposed along the front end, the right end, and the left end, the drink holder rack being pivotable from a retracted condition within the second recess to an extended condition, wherein each of the exterior side of the upper portion and the front end of the lower tray portion is disposed within the second recess when the drink holder rack is in the retracted condition, wherein each of the upper portion and the lower tray portion is perpendicular to the backrest portion and each of the exterior side of the upper portion and the front end of the lower tray portion is disposed outside the second recess when the drink holder rack is in the extended condition, further wherein the central aperture of the upper portion is aligned with the bottom end of the lower tray portion in a position directly above the bottom end when the drink holder rack is in the extended condition.

2. A chair with a backrest mounted item hook and drink holder comprising:

a chair body having a seat portion, a backrest portion attached to a frame disposed proximal a rear side of the seat portion, and a pair of legs attached to the seat portion and to a pair of outer portions of the frame, the backrest portion having a forward side, a rearward side, a top side, and a bottom side;

a first recess disposed within the rearward side of the backrest portion, the first recess having a top end proximal the top side of the backrest portion and a bottom end;

an arm member, the arm member having an attachment end and an external end, the attachment end pivotably disposed on the bottom end of the first recess, the arm member being pivotable from a retracted condition within the first recess to an extended condition, wherein the external end is disposed within the first recess when the arm member is in the retracted condition, wherein the arm member is perpendicular to the backrest portion and the external end is disposed outside the first recess when the arm member is in the extended condition;

a second recess disposed within the rearward side of the backrest portion in a position proximal the first recess, the second recess having an upper end proximal the top side of the backrest portion and a lower end; and a drink holder rack, the drink holder rack having an upper portion and a lower tray portion, the upper portion having an interior side pivotably disposed on the upper end of the second recess, an exterior side, and a central aperture disposed between the interior side and the exterior side, the lower tray portion having a proximal end pivotably disposed on the lower end of the second recess, a bottom end, a front end, a right end, a left end, and a vertical lip continuously disposed along the front end, the right end, and the left end, the drink holder rack being pivotable from a retracted condition within the second recess to an extended condition, wherein each of the exterior side of the upper portion and the front end of the lower tray portion is disposed within the second recess when the drink holder rack is in the retracted condition, wherein each of the upper portion and the lower tray portion is perpendicular to the backrest portion and each of the exterior side of the upper portion and the front end of the lower tray portion is disposed outside the second recess when the drink holder rack is in the extended condition, further wherein the central aperture of the upper portion is aligned with the bottom end of the lower tray portion in a position directly above the bottom end when the drink holder rack is in the extended condition.

3. The chair with a backrest mounted item hook and drink holder of claim 2 comprising a finger-grippable notch centrally disposed in a portion of the vertical lip on the front end of the lower tray portion of the drink holder rack, the notch being closed proximal the bottom end of the lower tray portion.

4. The chair with a backrest mounted item hook and drink holder of claim 2 wherein the arm member is parallelepiped.

5. The chair with a backrest mounted item hook and drink holder of claim 2 wherein the exterior side of the upper portion of the drink holder rack is convex.

6. The chair with a backrest mounted item hook and drink holder of claim 3 wherein the notch is u-shaped.

7. A chair with a backrest mounted item hook and drink holder comprising:

a stackable chair body having a seat portion, a backrest portion attached to a frame disposed proximal a rear side of the seat portion, and a pair of legs attached to the seat portion and to a pair of outer portions of the frame, the backrest portion having a forward side, a rearward side, a top side, and a bottom side;

a first recess disposed within the rearward side of the backrest, the first recess having a top end proximal the top side of the backrest portion and a bottom end;

a parallelepiped arm member, the arm member having an attachment end and an external end, the attachment end pivotably disposed on the bottom end of the first recess, the arm member being pivotable from a retracted condition within the first recess to an extended condition, wherein the external end is disposed within the first recess when the arm member is in the retracted condition, wherein the arm member is perpendicular to the backrest portion and the external end is disposed outside the first recess when the arm member is in the extended condition;

a second recess disposed within the rearward side of the backrest portion in a position proximal the first recess, the second recess having an upper end proximal the top side of the backrest portion and a lower end;

a drink holder rack, the drink holder rack having an upper portion and a lower tray portion, the upper portion having an interior side pivotably disposed on the upper end of the second recess, a convex exterior side, and a central aperture disposed between the interior side and the exterior side, the lower tray portion having a proximal end pivotably disposed on the lower end of the second recess, a bottom end, a front end, a right end, a left end, and a vertical lip continuously disposed along the front end, the right end, and the left end, the drink holder rack being pivotable from a retracted condition within the second recess to an extended condition, wherein each of the exterior side of the upper portion and the front end of the lower tray portion is disposed within the second recess when the drink holder rack is in the retracted condition, wherein each of the upper portion and the lower tray portion is perpendicular to the backrest portion and each of the exterior side of the upper portion and the front end of the lower tray portion is disposed outside the second recess when the drink holder rack is in the extended condition, further wherein the central aperture of the upper portion is aligned with the bottom end of the lower tray portion in a position directly above the bottom end when the drink holder rack is in the extended condition; and a finger-grippable u-shaped notch centrally disposed in a portion of the vertical lip on the front end of the lower tray portion of the drink holder rack, the notch being closed proximal the bottom end of the lower tray portion.

* * * * *